United States Patent [19]

Wilson et al.

[11] Patent Number: 4,943,781

[45] Date of Patent: Jul. 24, 1990

[54] CYCLOTRON WITH YOKELESS SUPERCONDUCTING MAGNET

[75] Inventors: Martin N. Wilson, Abingdon; Martin F. Finlan, Aylesbury, both of Great Britain

[73] Assignees: Oxford Instruments, Ltd., Oxford; Amersham International PLC, Little Chalfont, both of Great Britain

[21] Appl. No.: 382,035

[22] Filed: Jul. 18, 1989

Related U.S. Application Data

[63] Continuation of Ser. No. 80,470, filed as PCT GB86/00284 on May 21, 1986, published as WO86/00722 on Dec. 4, 1986, abandoned.

[30] Foreign Application Priority Data

May 21, 1985 [GB] United Kingdom ..... 8512804

[51] Int. Cl.[5] ..... H05H 13/00; H05H 13/06

[52] U.S. Cl. ..... 328/234; 313/62; 335/216

[58] Field of Search ..... 313/62; 328/234; 335/216 (U.S. only); 376/112

[56] References Cited

U.S. PATENT DOCUMENTS

| | | | |
|---|---|---|---|
| 3,624,527 | 11/1971 | Hudson | 328/234 |
| 3,794,927 | 2/1974 | Fleischer et al. | 328/234 X |
| 3,868,522 | 2/1975 | Bigham et al. | 313/62 |
| 3,925,676 | 12/1975 | Bigham et al. | 376/112 |
| 4,641,104 | 2/1987 | Blosser et al. | 313/62 X |

OTHER PUBLICATIONS

IEEE Transactions on Magnetics, vol. MAG-11, No. 2, Mar. 1975, N.Y., Schneider et al., "Superconducting Cyclotrons," pp. 443-446.

"The JINR U-400 Isochronous Heavy Ion Cyclotron", by B. N. Markov, *IEEE Transactions on Nuclear Science*, vol. NS-24, No. 3, Jun. 1977, pp. 1215-1217.

"Extraction of a Beam . . . Isochronous Heavy-Ion Cyclotron . . . ," by I. A. Shelaev et al., *Instrum. & Exp. Tech.* (U.S.A.), No. 3, May-Jun. 1970, pp. 689-692.

*Primary Examiner*—Palmer C. DeMeo

*Attorney, Agent, or Firm*—Spencer & Frank

[57] ABSTRACT

A cyclotron having a cylindrical superconducting magnet which generates an axial magnetic field and has a central opening or chamber of substantially circular cross-section. The accelerating beam space is located in this chamber lying normal to the axis of the magnetic field. The azimuth variation of magnetic field as well as the isochronous radial variation of magnetic field required to control the orbiting of the ion beam in the beam space, are provided by ferro-magnetic pole pieces located in the axial chamber, which interact with the magnetic field to cause the required field variations. Interposed between the pole pieces are resonant frequency members which provide the radio frequency energization to accelerate the ion beam around the beam space. Having the whole of the central chamber free for top and bottom access enables the pole pieces to be given an efficient design shape. Also, the radio frequency members are able to be interposed between the pole pieces and are not restricted as to axial length and so can be made a very efficient length, such as quarter wave length resonators. The radio frequency members have axially extending hollow interiors which open into the beam space and this enables vacuum pumping to communicate through these interiors thus allowing very efficient pumping of the beam space. There is no iron yoke for the magnet and the weight and size are consequently much reduced and the cyclotron is highly transportable.

12 Claims, 6 Drawing Sheets

CYCLOTRON WITH YOKELESS SUPERCONDUCTING MAGNET

This application is a continuation of application Ser. No. 07/080,470, filed as PCT GB86/00284 on May 21, 1986, published as WO86/07229 on Dec. 4, 1986, now abandoned.

BACKGROUND OF THE INVENTION

The present invention relates to cyclotrons which are devices for accelerating a beam of ionized particles around a substantially spiral path lying normal to an axial magnetic field, so as to produce a continuous output beam of particles at the high energy levels required for research and other purposes involving ion bombardment.

In a cyclotron a beam of ionized particles travels past electrodes which are paired to have opposing electrical voltages applied to them. With each transition of the ionized particles past the differential voltage of a pair of electrodes, the particles gain energy. The voltages applied to the electrodes are alternating voltages of radio frequency and are applied at a frequency to synchronise with the transitions of the ionized particles. By causing the ionized particles to travel in a roughly circular path which lies normal to an axial magnetic field, the particles can be made to make numerous transitions past a small number of electrode pairs receiving acceleration and gaining in radius at each transition.

There is problem with the classical designs of cyclotrons caused by relativistic effects which increase the mass of the ion particles causing them to move more slowly and lose synchronism with the radio frequency energisation being applied to the electrodes.

The particles can be brought back up to the required speed and thus kept in synchronism with the radio frequency energisation by increasing the strength of the magnetic field with radius. The magnetic field is then said to have an isochronous field shape. This field shape does, however, cause a loss of focussing of the beam of ionized particles and to re-focus the particles as azimuthal variation or 'flutter' is incorporated into the magnetic field.

Cyclotrons are usually constructed using resistive magnet coils enclosed within ferro-magnetic yokes, but the bulk and weight of these magnets has limited their use to establishments with large premises to house them. In addition, the amount of energy required to power the resistive coils puts a substantial demand on the electrical supply.

Designs of cyclotrons have been proposed using superconducting magnets but these have used ferro-magnetic yokes and have been fairly substantial in bulk and weight.

SUMMARY OF THE INVENTION

The present invention provides a design of cyclotron using a superconducting magnet which has no iron yoke. The desired isochronous field variation in the radial direction and the desired variation of magnetic field in the azimuth direction are both achieved.

According to the invention there is provided a cyclotron comprising a susperconducting magnet having at least one cylindrical magnet coil arranged in a cyrostat to provide a magnetic field extending axially of said coil, said cryostat defining an axial chamber having a substantially circular cross-section and containing said magnetic field, characterised in that said superconducting magnet provides yokeless means for generating said magnetic field, and in that interacting means are disposed in said chamber and arranged to interact with said magnetic field to provide a 'flutter' or variation of the axial magnetic field in the azimuthal direction in relation to said axis and to provide an isochronous variation of said axial magnetic field in the radial direction from said axis, and further that resonant cavity means are disposed in said chamber and arranged to provide an accelerating field for a beam of ionized particles, said interacting means and said resonant cavity means together defining a beam space disposed in the radial direction from said axis in which said beam of ionized particles can be accelerated.

Preferably, said interacting means comprise sector-shaped ferro-magnetic pole pieces and said resonant cavity means comprise sector-shaped members interposed between said pole pieces.

BRIEF DESCRIPTION OF THE PREFERRED EMBODIMENTS

Figure 1:
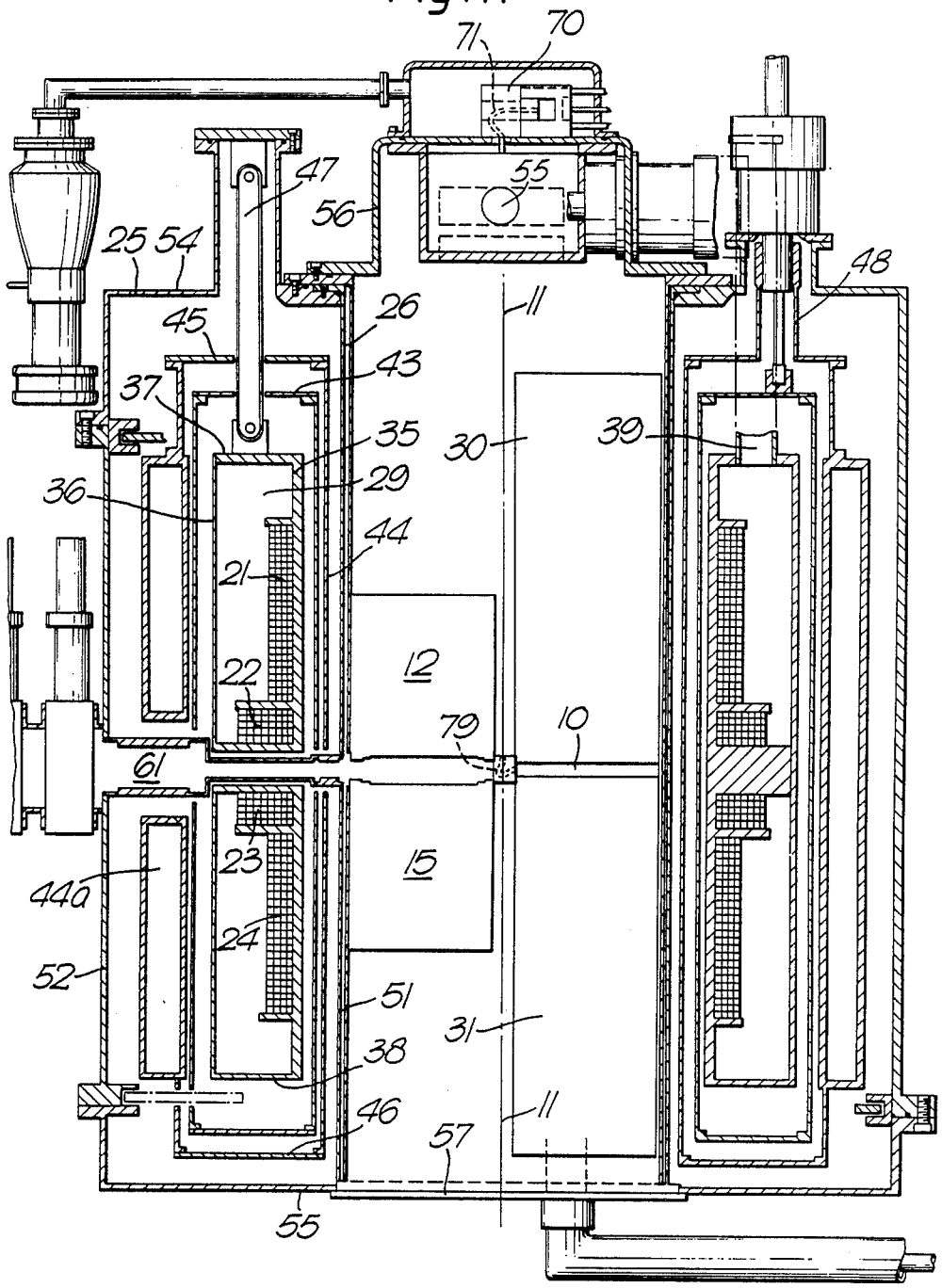
FIG. 1 is a vertical section through a cyclotron constructed in accordance with the invention.
Figure 2:
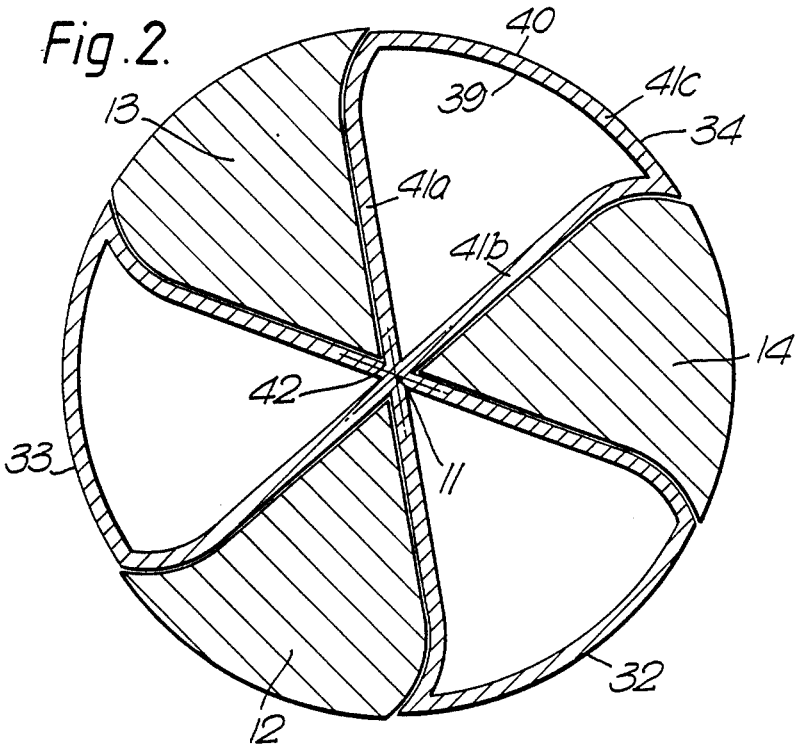
FIG. 2 is a cross-sectional plan taken through the beam space of the cyclotron of FIG. 1, to a different scale.
Figure 3:
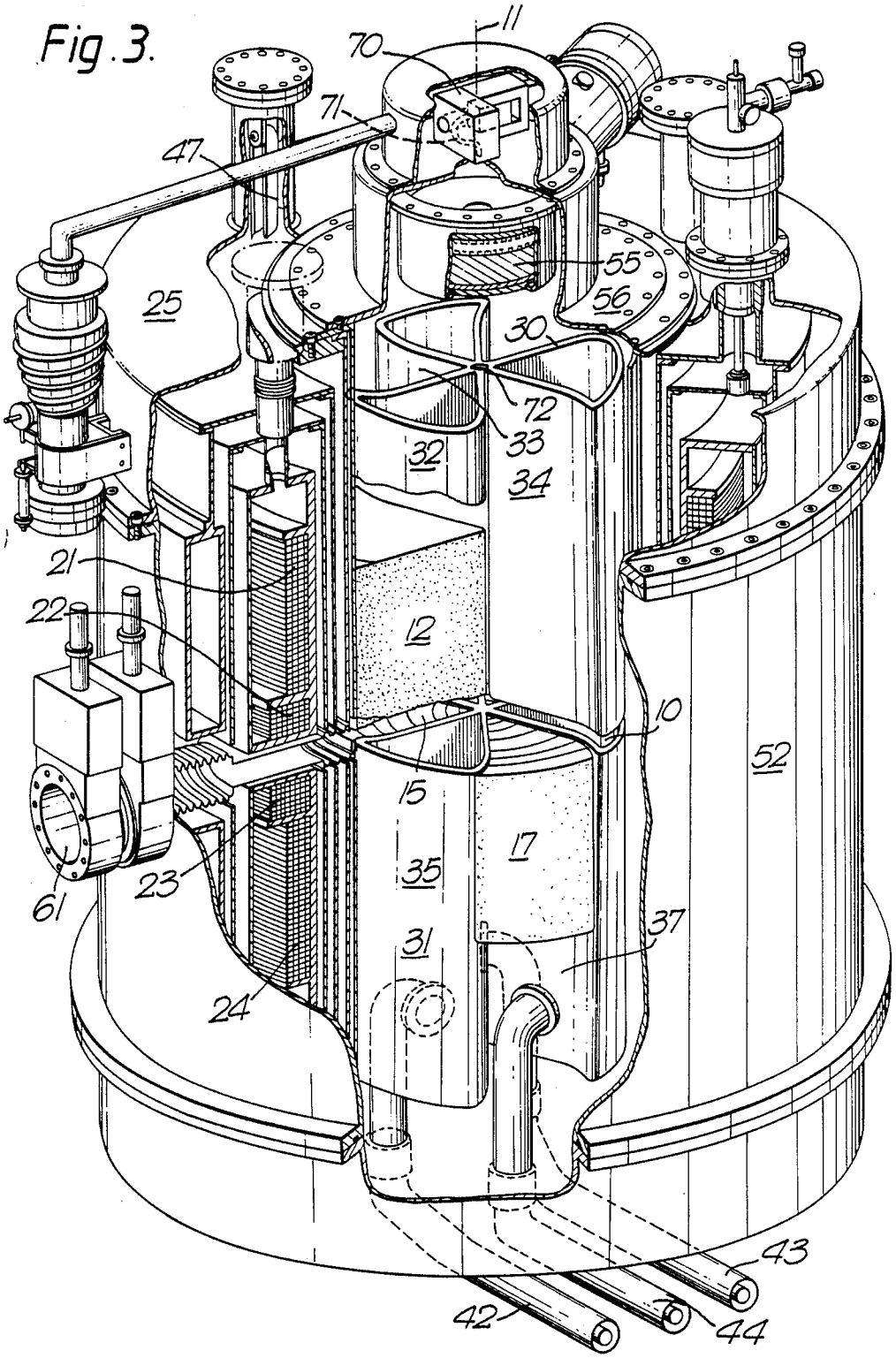
FIG. 3 is a cut-away perspective view of the cyclotron of FIGS. 1 and 2.

Referring to FIGS. 1–3, the accelerating action of the cyclotron is provided to a stream or beam of ionized particles which is continuously injected into the centre of a disc-shaped beam space 10.

An axial magnetic field extends parallel to a central axis 11 of the cyclotron (beam space 10 extending radially outwards from this axis 11) and receives azimuthal and radial variations in the region of beam space 10 by interaction with interacting means in the form of soft iron pole pieces 12 through to 17.

The axial magnetic field is provided by yokeless means in the form of a superconducting magnet 29 having a set of superconducting magnet coils 21 through to 24 which are housed in a cryostat 25, so that the coils are kept close to absolute zero for superconducting operation. The cryostat 25 is of cylindrical shape and defines a central cyclindrical axially extending opening or chamber 26. Constructional details of the cryostat 25 will be described later.

The soft iron pole pieces are provided as three upper pole pieces 12, 13, 14 disposed at 120° intervals around the axis 11 within chamber 26. A lower set of soft iron pole pieces 15, 16, 17 is also disposed at 120° intervals around the axis 11 within the chamber 26, with lower pole piece 15 aligned axially with upper pole piece 12 and the other pole pieces similarly aligned. The shape, disposition and magnetic properties of the pole pieces are designed and selected so as to provide the desired variations in field strength to the axial field.

Figure 6:
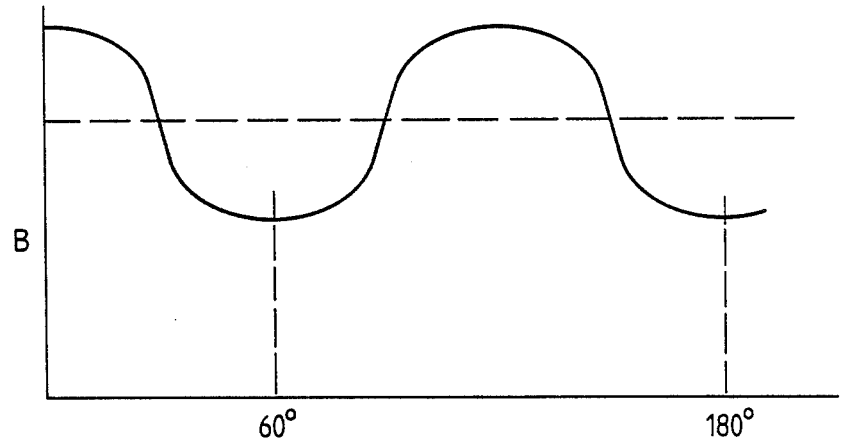
FIG. 6 is a plot of the azimuth variation of the magnetic field.
Figure 7:
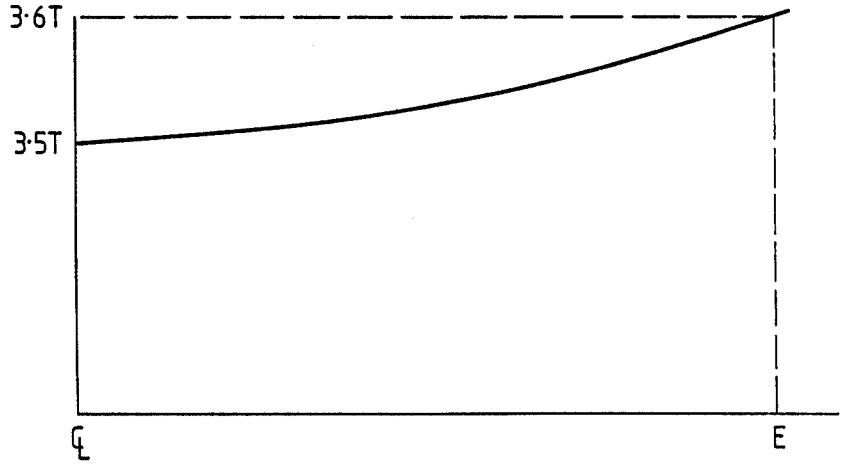
FIG. 7 is a plot of the isochronous variation of the magnetic field.

FIGS. 6 and 7 show respectively the azimuthal variations and the isochronous radial shape of the magnetic field.

FIG. 6 shows low the field strength varies around the circumference of the cyclotron, with the position of two of the pole pieces 12–17 shown at 60° and 180°. FIG. 7 shows the radial variation of the magnetic field from 3.5T at the axis 11 of the cyclotron, to 3.6T at the circumference E, these figures for field strength being merely typical.

Referring again to FIGS. 1 to 3, radio frequency energisation is supplied to the beam of particles orbiting in the beam space 10 through radio frequency cavity means in the form of members 30, 31 also disposed in chamber 26. These members comprise an upper set of sector-shaped extensions 32, 33, 34 spaced at 120° intervals around the axis 11 of the cyclotron and extending axially upwards from the beam space 10 and radially outwards from the axis 11 and interposed between the pole pieces 12 to 14.

As shown more particularly in FIG. 2, the extensions 32 through to 34 each comprise a prism-shaped copper shell 39 nested inside another larger prism-shaped copper shell 40, the shells 39, 40 being spaced apart to form a narrow cavity 41. The outer shells 40 are joined axially to adjacent shells at the centre of the cyclotron, as at 42, and the cavities 41 of all three extensions 32 through to 34, thus communicate at the centre.

Each extension appears, in a cross-section normal to axis 11, as in fIG. 2, as a sector-shaped cavity strip having two arms **41*a* and 41*b* extending substantially radially outwards from axis 11 and with a circumferential arm 41*c***.

A lower set of extensions 35, 36, 37 is similarly spaced around axis 11, similarly joined one to the other at the center, similarly disposed in chamber 26 and similarly interposed between the lower pole pieces. Each extension 35–37 aligns axially with one of the extensions of the upper set.

As best seen in FIG. 3, each of extensions 32 through to 34 lies axially opposite an extension of the lower set 35 through to 37 and opposing extensions are spaced apart axially to define, in part, the beam space 10. Similarly, the pole pieces 12 through to 14 lie axially opposite the pole pieces 15 through to 17 of the lower set and are also spaced apart axially to define, in part, the beam space 10.

The interpositioning of resonant cavity members 32 through to 37 circumferentially between the pole pieces 12 through to 17, allows the resonant cavities to be extended axially for as far as is necessary for them to provide efficient delivery of the radio frequency energisation. In the example, they are made to be one quarter of the wavelength of the required radio frequency energisation. The cavities 41 are closed at their ends remote from the beam space 10 to form quarter wave resonators.

Radio frequency energisation is fed from respective co-axial cables 42 through to 44 into the cavities 41 between the inner and outer shells 39, 40, so as to produce a large sinusoidally oscillating voltage between the ends of the cavities adjacent the beam space 10.

The cavities of all three extensions in the upper set along with all three cavities of the extensions in the lower set, are energised in phase and, in the example, they are supplied with radio frequency waves at a frequency three times the revolution frequency of the ionized particles.

Figure 5:
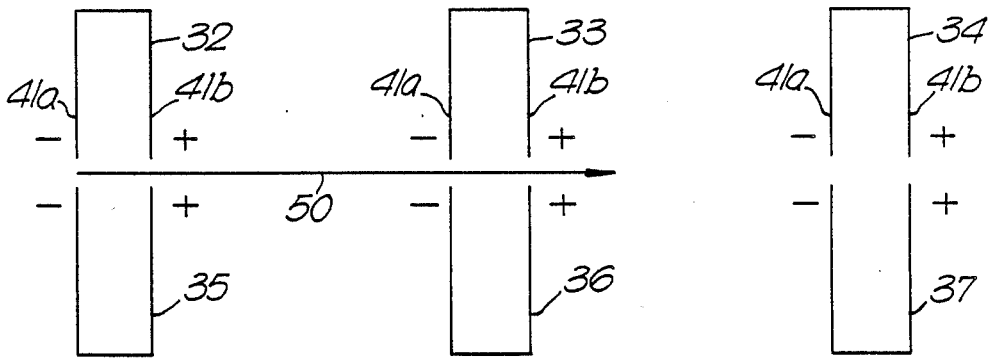
FIG. 5 is a developed plan of the resonant cavities of the cyclotron of FIG. 1.

Referring now to FIG. 5, there is shown a developed axial section through the three radio cavity extensions of both upper and lower sets. The beam 50 travels from left to right, as shown, and the radio frequency energisation is synchronised to provide the required polarity to accelerate the partilces as they pass each of the cavities.

Because each of the ionized particles passes the two sides or shells making up each cavity and because the phase of the voltages applied to these sides is synchronised to provide accelerating voltages as the particles pass, the particles are given six accelerating voltage 'kicks' per revolution. Each voltage kick is typically 30 kV and the ion revolution frequency is 50 MHz, i.e. each orbit increases the energy by 180 kV and the cavity frequency is 150 MHz.

Figure 8:
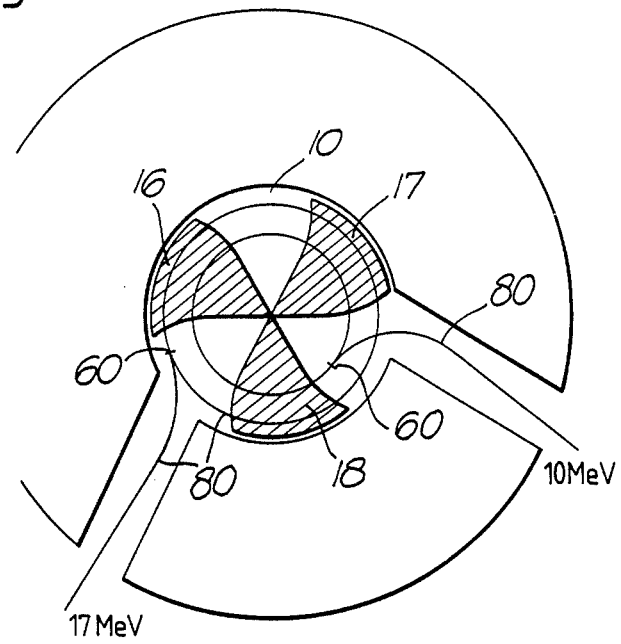
FIG. 8 is a cross-sectional plan of the cyclotron showing the output beam, and, FIG. 9 is a cross-sectional plan similar to FIG. 8 showing an alternative output beam arrangement.

When the particles reach the required energisation they are removed from the cyclotron. As shown in FIG. 8 using negative ions, at the appropriate point in the spiral path of the beam 80, the particles are caused to strike a thin carbon foil 60.

This foil 60 strips negative charge from the ions, thereby converting them to positive ions. As such they are deflected by the axial magnetic field in a direction radially outwards and thus pass out of a delivery pipe 61. The foil can have any number of alternative positions depending on the energy required in the output particles: thus, by changing the positon of the foil, alternative outputs of 10 MeV and 17 MeV can be obtained.

The stream of ions is provided by an ion source 70 which is situated on top of the cyclotron. The ion source 70 emits a stream of negative ions radially outwards: the stream is turned immediately through 90° by the magnetic field and the majority of the concomitant hydrogen gas is removed at this point by differential vacuum pumping. The facility easily to remove gas from the ion stream, along with the facility for extremely efficient pumping of the beam space, contributes to the excellent overall efficiency of the cyclotron.

The stream of negative ions from source 70 is shown at 71. It is turned immediately through 90° so as to be directed along the central axis 11 and passes through a hole 72 provided in the top of the resonant cavity members 32 to 34, on its passage to the beam space 10.

As shown in FIG. 1, the ion stream is again turned through 90°, as shown at 79, and then starts its orbits in the beam space 10.

Figure 4:
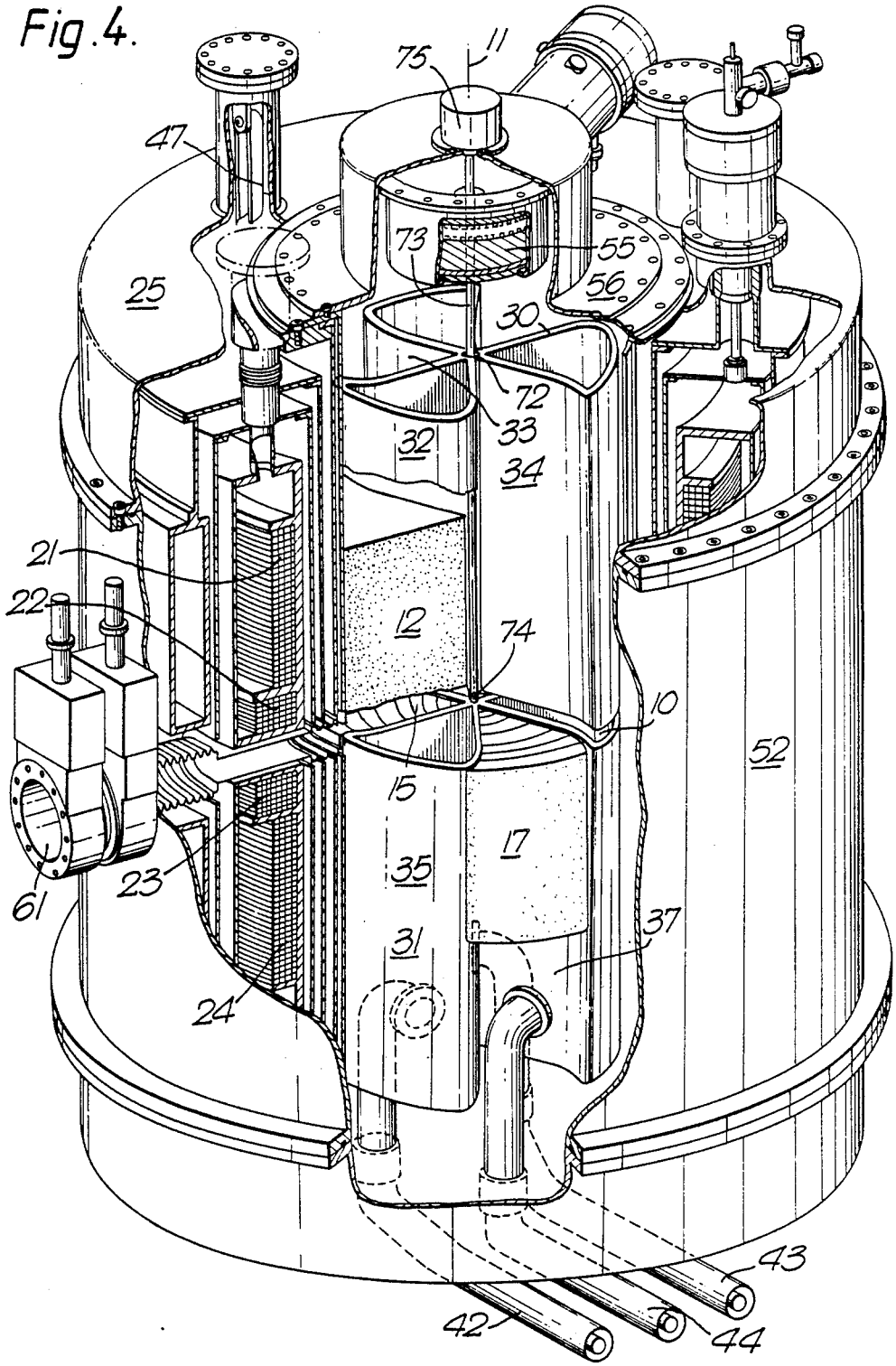
FIG. 4 is a cut-away perspective view of another cyclotron similar to that of FIG. 3.

FIG. 4 shows a cyclotron which is very similar to that shown in FIG. 3. In this case the ion generator is in the beam space 10 at 74, and is supplied from a services unit 75 along a tube 73, the ion stream issuing from a hole in tube 73 at 74.

In respect of both cyclotrons, the ion stream is delivered to the centre of the beam space 10. At the center of the beam space, this stream begins it spiral path into the flat disc-shaped beam space 10.

In the arrangements of both FIGS. 3 and 4, either positive ions or negative ions can be delivered by the ion sources shown. When positive ions are used the extraction foil shown in FIG. 8 cannot be used and the acelerated ions are extracted by the arrangement shown in FIG. 9.

Figure 9:
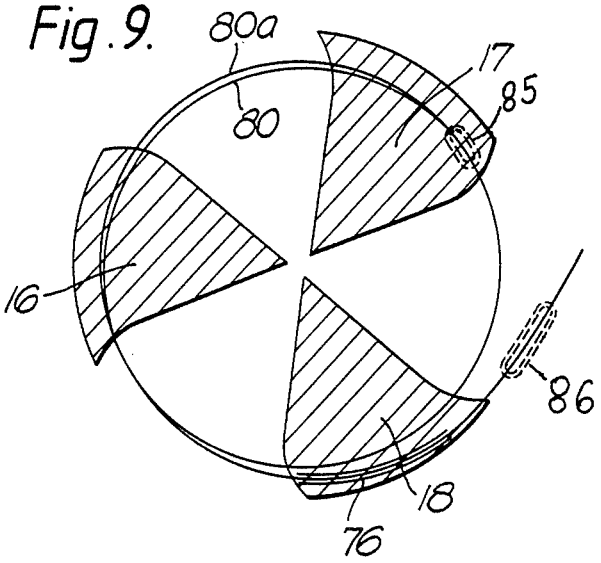

In FIG. 9, as the ion stream 80 reaches an outer orbit it enters a region of changed magnetic field 85. This deflects the ion stream into a slightly different orbit **80*a* so that it enters an electrostatic deflector 76 and is caused to enter another region of changed magnetic field 86** and it leaves the cyclotron tangentially.

Alternatively, a target, which is the actual workpiece, is positioned within the beam space 10 in the path of the ion stream so that the ions impinge directly on it.

The circumferential spaces between the sector-shaped iron pole pieces 12–14 and 15–17 are completely clear of ferro-magnetic material and this feature enables an enhanced amplitude of the azimuthal field variation or 'flutter', caused by the interaction of the main field and the pole pieces, to be obtained.

Furthermore, by placing the radio frequency cavities in these spaces, the cavities can be made in a more efficient shape and can be provided in greater number than in conventional designs, thus providing greater acceleration per turn of the helical path of the ionised particles.

In addition, the inner shell 39 of each cavity extension is hollow and open at top and bottom thereby providing a clear, low impedance, axially extending path between the beam space 10 and a vacuum pump 55. Pump 55 is mounted on a plate 56 which closes the upper end of chamber 26, whilst a plate 57 closes the lower end.

The cyclotron is thus constructed without an iron yoke making it very lightweight and portable. Such a cyclotron is very suitable for neutron radiography and neutron therapy.

Turning now to the detail of the cryostat 25, the four cylindrical magnet coils 21, 22, 23, 24 in the cryostat 25 are mounted on a cylindrical former 35.

The former 35, along with a cylindrical shell 36 and end plates 37, 38, defines a liquid helium bath having an entry 39 for passage of leads and for pouring in liquid helium so that the coils 21 through to 24 operate immersed in liquid helium as superconducting coils.

Also housed within the cryostat is a radiation shield 43 and a double walled cylindrical container 44 which includes a liquid nitrogen bath **44*a*. The container 44 is suspended from top and bottom plates 45, 46 of the cryostat by arms 48 and the helium bath is suspended from arms 47**, all these suspension arms being made of material which resists the transmission of heat.

The inner and outer cylindrical walls 51, 52 of the cryostat, together with top and bottom plates 54, 55 define a vacuum chamber which is evacuated to resist the ingress of heat.

The design of the cryostat follows standard modern practice for superconducting magnets of high performance with the coils kept close to absolute zero in the bath of liquid helium and the rest of the structure designed to resist the ingress of heat and minimise the boil-off of helium and nitrogen.

We claim:

1. A cyclotron comprising a superconducting magnet having at least one cylindrical magnet coil arranged in a cryostat to provide a magnetic field extending axially of said coil, said cryostat defining an axial chamber having a substantially circular cross-section and containing said magnetic field, wherein said superconducting magnet provides yokeless means for generating said magnetic field, wherein interacting means are disposed in said chamber and arranged to interact with said magnetic field to provide a 'flutter' or variation of the axial magnetic field in the azimuthal direction in relation to said axis and to provide an isochronous variation of said axial magnetic field in the radial direction from said axis, wherein resonant cavity means are disposed in said chamber and arranged to provide an accelerating field for a beam of ionized particles, said interacting means and said resonant cavity means together defining a beam space disposed in the radial direction from said axis in which said beam of ionized particles is accelerated, and wherein each said at least one cylindrical magnet coil defines an internal radius greater than the radius defined by said beam space.

2. A cyclotron as claimed in claim 1, wherein said interacting means comprise sector-shaped ferro-magnetic pole pieces and said resonant cavity means comprise sector-shaped members interposed between said pole pieces.

3. A cyclotron as claimed in claim 2, wherein the resonant cavity members extend axially to a length capable of providing efficient resonance for providing accelerating energisation.

4. A cyclotron as claimed in claim 1, wherein means are provided for injecting a stream of ionized particles axially along the magnetic field into said beam space.

5. A cyclotron as claimed in claim 4, wherein said means comprises a negative ion generator arranged to inject a stream of negative ions into said beam space and that a stripper foil is provided for extracting the energised ions.

6. A cyclotron as claimed in claim 1, wherein means are provided for injecting a stream of ionized particles directly into said beam space.

7. A cyclotron as claimed in claim 4, wherein said means comprises a positive ion generator and that a region of reduced magnetic field is provided for extracting the energised ions.

8. A cyclotron as claimed in claim 2, wherein the resonant cavity members have hollow interior spaces communicating with said beam space and with vacuum pumping means.

9. A cyclotron as claimed in claim 2, wherein the radial boundaries of the ferro-magnetic pole pieces are in the shape of straight radial lines or in the shape of spirals or in a combination of both.

10. A cyclotron as claimed in claim 2, wherein the radial boundaries of the resonant cavity members are in the shape of straight radial lines or in the shape of spirals or in a combination of both.

11. A cyclotron comprising a superconducting magnet having at least one cyclindrical magnet coil with a given internal radius arranged in a cryostat to provide a magnetic field extending axially of said coil, said superconducting magnet providing said magnetic field in the absence of a yoke, said cryostat defining a chamber which has a common axis with said coil and which has a substantially circular cross-section and thereby contains said magnetic field, interacting means disposed in said chamber to interact with said axial magnetic field to provide a flutter or variation of the axial magnetic field in the azimuthal direction in relation to said axis and to provide an isochronous variation of said axial magnetic field in the radial direction from said axis, wherein the entire cylindrical volume of said chamber is available to contain:

(i) said interacting means;

(ii) resonant cavity means which provide an accelerating field for a beam of ionized particles; and (iii) a beam space defined by said interacting means and said resonant cavity means to extend radially outwardly from said axis, said beam space being provided for the acceleration of said beam of ionized particles radially outwardly of said axis, the radius of said beam space being less than the internal radius of each said at least one cylindrical magnet coil.

12. A cyclotron comprising a cryostat defining a chamber having a substantially circular cross-section and a longitudinal axis;

a superconducting magnet positioned within said cryostat, said superconducting magnet comprising at least one cylindrical magnet coil, having a given internal radius, surrounding said chamber for generating an axial magnetic field within said chamber, said magnetic field extending along and radially outward from said longitudinal axis;

interacting means disposed within said chamber for interacting with said axial magnetic field, said interacting means providing as a result of said interaction a variation in said magnetic field in the azimuthal direction about said longitudinal axis and an isochronous variation of said magnetic field in the radial direction extending from said longitudinal axis; and resonant cavity means disposed within said chamber adjacent said interacting means, said resonant cavity means and said interacting means defining a beam space disposed radially from said longitudinal axis and having a radius less than the given internal radius of each said at least one cylindrical magnet coil, a beam of ionized particles entering said beam space being accelerated radially outward from said longitudinal axis by a field generated by said resonant cavity means.

* * * * *